US011526106B2

(12) United States Patent
Mori et al.

(10) Patent No.: US 11,526,106 B2
(45) Date of Patent: Dec. 13, 2022

(54) IMAGE FORMING APPARATUS

(71) Applicant: CANON KABUSHIKI KAISHA, Tokyo (JP)

(72) Inventors: Eikou Mori, Tokyo (JP); Naoto Tokuma, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/579,660

(22) Filed: Jan. 20, 2022

(65) Prior Publication Data

US 2022/0244669 A1 Aug. 4, 2022

(30) Foreign Application Priority Data

Jan. 29, 2021 (JP) ..... JP2021-013708

(51) Int. Cl.
*G03G 15/00* (2006.01)

(52) U.S. Cl.
CPC ..... *G03G 15/5016* (2013.01)

(58) Field of Classification Search
CPC ..... G03G 15/5016; G03G 15/5062; G03G 15/5095; G03G 2215/00569; G03G 2215/00776
See application file for complete search history.

(56) References Cited

U.S. PATENT DOCUMENTS 11,099,512 B2 * 8/2021 Igarashi ..... G03G 15/5016
2018/0165044 A1 * 6/2018 Tanaka ..... G06F 3/1208

FOREIGN PATENT DOCUMENTS

JP 2005-221582 A 8/2005
JP 2018-097111 A 6/2018

OTHER PUBLICATIONS

Eikou Mori et al., U.S. Patent Application No. 17/700,7030, filed Mar. 22, 2022.

* cited by examiner

*Primary Examiner* — Hoang X Ngo
(74) *Attorney, Agent, or Firm* — Venable LLP

(57) ABSTRACT

An image forming apparatus includes: an image forming unit configured to form an image on a sheet; a conveyance unit configured to convey the sheet having the image formed thereon along a conveyance path; a reading unit configured to read the image on the sheet conveyed to the conveyance path; and a controller configured to: receive a user-designated number of sheets as a condition for a timing at which the image forming unit forms a mark during a period in which a print job for forming a plurality of images on a plurality of sheets is being executed; control, when the print job is executed, the image forming unit to form the mark after the images are formed on sheets of a predetermined number smaller than a threshold number of sheets in a case in which the user-designated number of sheets is larger than the threshold number of sheets.

7 Claims, 13 Drawing Sheets

IMAGE FORMING APPARATUS

BACKGROUND OF THE INVENTION

Field of the Invention

The present disclosure relates to an image forming apparatus, for example, a copying machine, a multifunction peripheral, and a printer.

Description of the Related Art

In recent years, the market for an on-demand image forming apparatus is expanding. For example, in an offset printing market, electrophotographic image forming apparatus are becoming widespread. Image forming apparatus employing an inkjet system, which have succeeded in cultivating a wide market for reasons such as a large format, a low initial cost, and an extremely high speed, are also expanding its share in the market for on-demand image forming apparatus. However, expansion of the market is not easy, and an image forming apparatus must maintain quality of images (hereinafter referred to as "image quality") of preceding image forming apparatus that have served the market. In order to maintain the image quality, an image forming condition to be used when the image forming apparatus forms an image on a sheet is appropriately corrected.

The image quality includes a tone characteristic, granularity, in-plane evenness, letter quality, and color reproducibility (including color stability). As another important factor of the image quality, there is "front/back registration accuracy." The front/back registration accuracy refers to accuracy in registration of images on a front surface and a back surface of a sheet. A deviation between positions (printing positions) of images on the front surface and the back surface of a sheet (printed product) on which the images have been formed is called "front/back misregistration." With offset printing machines, the front/back registration accuracy is adjusted by a skilled technician before printing, and the front/back misregistration is suppressed to from about 0.1 to about 0.2. However, the adjustment of the front/back registration accuracy requires time and requires proficient skills.

An electrophotographic image forming apparatus using toner is widely known as a digital printing apparatus that satisfies the needs for high-mix low-volume printing. The image forming apparatus fixes the toner to the sheet by heat and pressure. Therefore, for example, the sheet shrinks after printing on the first surface. This causes print misregistration between the first surface and the second surface, that is, front/back misregistration. In addition, an image forming apparatus that handles cut sheets including the above-mentioned electrophotographic image forming apparatus provides high-precision printing position stability by way of registration of the sheet. Normally, the registration is performed with one side of a rectangular sheet being used as a reference, and hence variations in the front/back registration accuracy for each sheet is affected by the cutting accuracy of the sheet and the deformation of the sheet.

Factors that determine the cutting accuracy of the sheet and the sheet shape including the deformation of the sheet include perpendicularity and parallelism in addition to the length of each side of the sheet. The shape of the sheet varies depending on a difference in sheet cutting between lots and the surrounding environment. The front/back registration accuracy is affected by the shape of the sheet. Therefore, in order to provide the front/back registration accuracy equivalent to that of offset printing in the image forming apparatus that handles cut sheets, work for adjusting the front/back misregistration by adjusting the printing position, magnification, and distortion is required every time the sheet cutting lot or setting environment changes. Such work is called "front/back registration." The front/back misregistration also occurs due to variations in the sheet shape during a job and variations in the image shape in an image formation process. In Japanese Patent Application Laid-open No. 2005-221582, there is disclosed an image forming apparatus in which printing position adjustment is automatically executed by interrupting a job at printing intervals of a predetermined number of sheets during the job.

When sheets taken out from a package are stored in a sheet feeding cassette of an image forming apparatus installed in a room with low humidity, a content of moisture contained in the sheets decreases with a lapse of time. Therefore, the dimensions of each sheet stored in the sheet feeding cassette become smaller with a lapse of time than immediately after the package was opened. In contrast, when an environment in which the sheets are left-unattended or left alone is high in humidity, the dimensions of the sheets stored in the sheet feeding cassette become larger than immediately after the package was opened. As described above, the variations in the content of moisture contained in the sheets cause the dimensions of each sheet to change (cause the sheet shape to vary), to thereby cause the front/back misregistration. In Japanese Patent Application Laid-open No. 2018-097111, there is disclosed an image forming apparatus in which a time interval for the printing position adjustment is gradually increased based on a left-unattended time of the sheets in the sheet feeding cassette.

As described above, a change in the dimensions of each sheet that has been taken out from the package causes the front/back misregistration. In Japanese Patent Application Laid-open No. 2005-221582, the printing position adjustment (front/back registration) is performed for each predetermined number of sheets, and hence the job is interrupted by the printing position adjustment at high frequency (for example, once every 50 sheets). This causes an increase in the number of waste sheets and a decrease in actual productivity. In contrast, when the printing position adjustment is performed at low frequency (for example, once every 100 sheets), the front/back misregistration in the early stage is aggravated.

In Japanese Patent Application Laid-open No. 2018-097111, the time interval for the printing position adjustment is gradually increased based on the left-unattended time of the sheets in the sheet feeding cassette. However, in actuality, only the sheet on the top surface of the sheets left unattended in a stacked state is stretched in most cases. Therefore, when the left-unattended time is short, only the sheet on the top surface is stretched, and hence the printing position adjustment is excessively executed. This causes an increase in the number of waste sheets and a decrease in actual productivity. In contrast, when the left-unattended time is long, the sheet on the top surface is stretched, and hence the front/back misregistration in the early stage is aggravated.

SUMMARY OF THE INVENTION

An image forming apparatus according to the present disclosure includes: an image forming unit configured to form an image on a sheet; a conveyance unit configured to convey the sheet having the image formed thereon along a conveyance path; a reading unit configured to read the image on the sheet conveyed to the conveyance path; and a controller configured to: receive a user-designated number of sheets as a condition for a timing at which the image forming unit forms a mark during a period in which a print job for forming a plurality of images on a plurality of sheets is being executed; control, when the print job is executed, the image forming unit to form the mark after the images are formed on sheets of a predetermined number smaller than a threshold number of sheets in a case in which the user-designated number of sheets is larger than the threshold number of sheets; control, when the print job is executed, the image forming unit to form the mark every time images are formed on the sheets of the user-designated number of sheets; control the conveyance unit to convey the sheet having the mark formed thereon; control the reading unit to read the mark on the sheet; and control geometric characteristics of an image to be formed on the sheet based on a result of reading the mark by the reading unit.

Further features of the present invention will become apparent from the following description of exemplary embodiments (with reference to the attached drawings).

DESCRIPTION OF THE EMBODIMENTS

Now, an embodiment of the present disclosure is described with reference to the accompanying drawings. In this embodiment, a method of solving the above-mentioned problems through use of an electrophotographic laser beam printer is described. The description is given by taking an electrophotographic system as an example, but in regard to the feature points of control, in particular, the matters described in the appended claims, there are similar problems due to image fixing of a heat-drying method even in an inkjet printer and a dye-sublimation printer, and those problems can be solved through use of the method described below. Therefore, it is claimed that the above-mentioned claims are also within the scope of the claims even in each type of image forming apparatus.

<Image Forming Apparatus>

Figure 1:
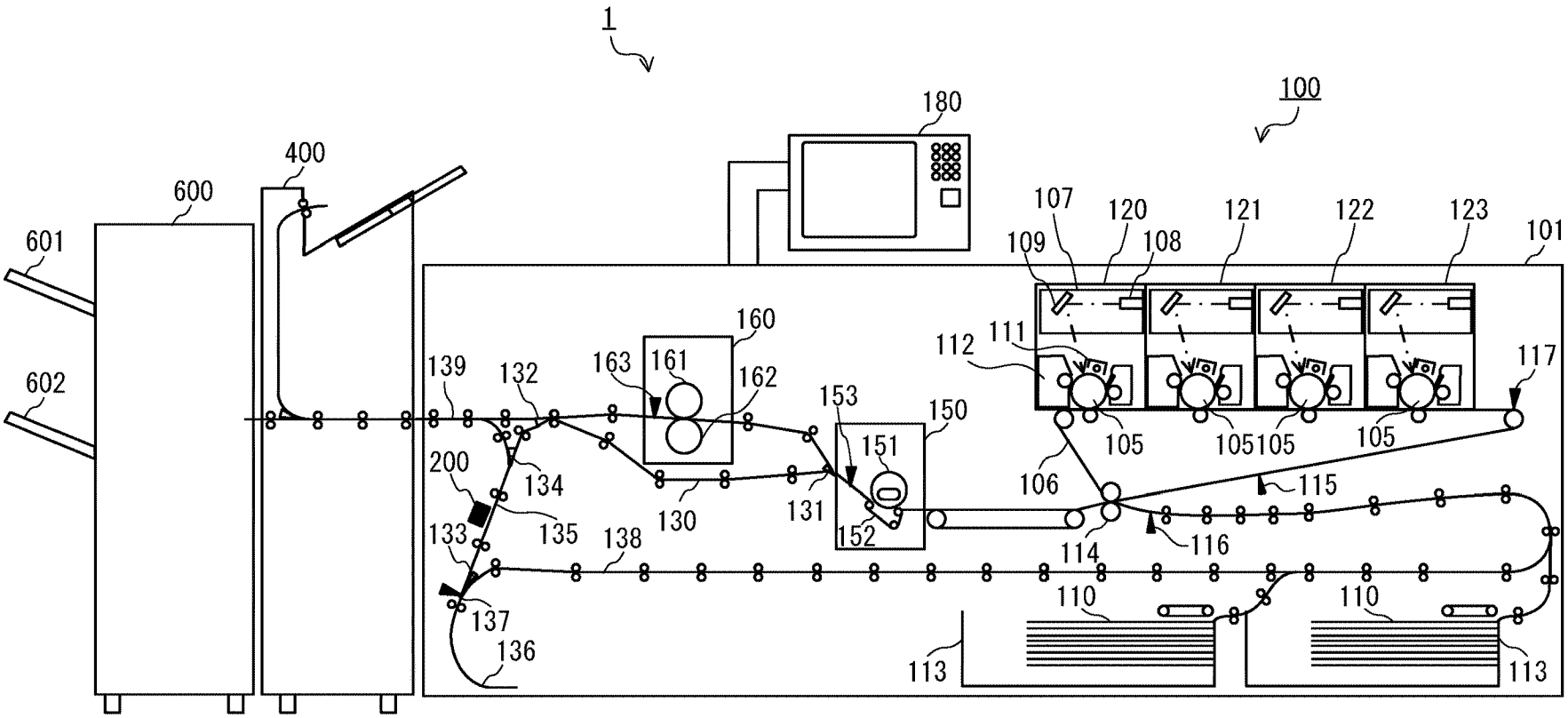
FIG. 1 is a configuration view of an image forming apparatus according to an embodiment of the present disclosure.

FIG. 1 is a configuration view of an image forming apparatus according to this embodiment. An image forming apparatus 1 according to this embodiment includes a printer 100, an adjustment unit 400, and a finisher 600. The printer 100 employs an electrophotographic system to form an image onto a sheet 110. The printer 100 in this embodiment may be an inkjet printer or a dye-sublimation printer.

The printer 100 includes, inside a casing 101, mechanisms which form an engine unit for use in image formation, and a controller to be described later. The controller controls operations of the mechanisms. An operation panel 180 is provided in an upper portion of the casing 101. The operation panel 180 is a user interface, and includes an input device for receiving instructions from a user, and an output device for displaying a screen, for example, an operation screen. The mechanisms which form the engine unit include a mechanism (image forming mechanism) for forming an image, a mechanism (transfer mechanism) for transferring the image onto the sheet 110, a mechanism (feeding mechanism) for feeding the sheet 110, and a mechanism (fixing mechanism) for fixing the image to the sheet 110.

The image forming mechanism includes four image forming units 120, 121, 122, and 123 corresponding to respective colors of yellow (Y), magenta (M), cyan (C), and black (K). The image forming units 120, 121, 122, and 123 form images of corresponding colors. The image forming units 120, 121, 122, and 123 have the same configuration, but differ only in color of an image to be formed. Description is given here of the configuration of the image forming unit 120, and description of the configurations of the other image forming units 121, 122, and 123 is omitted.

The image forming unit 120 includes a photosensitive drum 105, a charging device 111, a laser scanner 107, and a developing device 112. The photosensitive drum 105 is a drum-shaped photosensitive member having a charging layer on its surface, and is configured to rotate about a drum shaft. The charging device 111 uniformly charges the surface of the rotating photosensitive drum 105. The laser scanner 107 scans the photosensitive drum 105 with laser light modulated based on image data representing an image to be formed. The laser scanner 107 includes a light emitting portion 108 for scanning the laser light emitted from a semiconductor laser in one direction, and a reflective mirror 109 for reflecting the laser light emitted from the light emitting portion 108 toward the photosensitive drum 105. A direction in which the laser scanner 107 scans the photosensitive drum 105 (depth direction of FIG. 1) corresponds to a main scanning direction.

When the photosensitive drum 105 is charged and scanned with the laser light, an electrostatic latent image corresponding to the image data is formed on its surface. The developing device 112 develops the electrostatic latent image formed on the photosensitive drum 105 with developer. In this manner, a visible image of the electrostatic latent image is formed on the surface of the photosensitive drum 105. On the photosensitive drum 105 of the image forming unit 120, a yellow image is formed. On the photosensitive drum 105 of the image forming unit 121, a magenta image is formed. On the photosensitive drum 105 of the image forming unit 122, a cyan image is formed. On the photosensitive drum 105 of the image forming unit 123, a black image is formed. The photosensitive drum 105 and the developing device 112 are removable from the casing 101.

The transfer mechanism includes an intermediate transfer member 106 and transfer rollers 114. Onto the intermediate transfer member 106, images are sequentially transferred in superimposition from the photosensitive drums 105 of the respective image forming units 120, 121, 122, and 123. In this embodiment, the intermediate transfer member 106 is configured to rotate in the clockwise direction of FIG. 1, and images are transferred in order of the image forming unit 120 (yellow), the image forming unit 121 (magenta), the image forming unit 122 (cyan), and the image forming unit 123 (black). An image density detection sensor 117 is provided on the downstream of the image forming unit 123 in the rotating direction of the intermediate transfer member 106. The image density detection sensor 117 detects an image density from an image for image density detection formed on the intermediate transfer member 106.

The images transferred onto the intermediate transfer member 106 are conveyed to reach the transfer rollers 114 by rotation of the intermediate transfer member 106. An image formation start position detection sensor 115 is provided on the upstream of the transfer rollers 114 in the rotating direction of the intermediate transfer member 106. The image formation start position detection sensor 115 is used to determine a transfer position for transfer onto the sheet 110. The transfer rollers 114 bring the sheet 110 into pressure-contact with the intermediate transfer member 106, and are to be applied with a bias having an opposite characteristic to that of an image formed on the intermediate transfer member 106. Thus, the images are transferred onto the sheet 110 from the intermediate transfer member 106.

The feeding mechanism includes a sheet feeding cassette 113 for storing the sheet 110, a conveyance path through which the sheet 110 is to be fed, and various rollers for conveying the sheet 110 through the conveyance path. The sheet 110 is fed from the sheet feeding cassette 113, conveyed through the conveyance path so that the images are transferred and fixed to be formed thereon, and is discharged to the outside of the casing 101. In this embodiment, a plurality of sheet feeding cassettes 113 are provided, and the sheet can be fed from any one of the sheet feeding cassettes 113. The sheets 110 received in the respective sheet feeding cassettes 113 may be sheets of the same type, but may be sheets of different types.

The sheet 110 is first fed from the sheet feeding cassette 113, and is then conveyed through the conveyance path to reach the transfer rollers 114. A sheet feeding timing sensor 116 is provided in the middle of the conveyance path from the sheet feeding cassette 113 to the transfer rollers 114. The sheet feeding timing sensor 116 is used to adjust the timing to convey the sheet 110. The timing to convey the sheet 110 to the transfer rollers 114 is adjusted based on the timing at which the image formation start position detection sensor 115 detects the images formed on the intermediate transfer member 106 and the timing at which the sheet feeding timing sensor 116 detects the sheet 110. In this manner, the images are transferred onto a predetermined position of the sheet 110 from the intermediate transfer member 106.

The sheet 110 having the images transferred thereon is conveyed to the fixing mechanism. The fixing mechanism in this embodiment includes a first fixing device 150 and a second fixing device 160. The first fixing device 150 includes a fixing roller 151, a pressure belt 152, and a post-fixing sensor 153. The fixing roller 151 heats the sheet 110 in order to thermally pressure-fix the images onto the sheet 110. The pressure belt 152 is used to bring the sheet 110 to pressure contact with the fixing roller 151. The post-fixing sensor 153 detects that the fixing is finished. The fixing roller 151 is a hollow roller, and includes therein a heater. The fixing roller 151 is configured to rotate to convey the sheet 110. The post-fixing sensor 153 detects the sheet 110 subjected to image fixing.

The second fixing device 160 is arranged on the downstream with respect to the first fixing device 150 in the conveying direction of the sheet 110, and is used to add gloss to the image formed on the sheet 110 subjected to fixing processing by the first fixing device 150 or to ensure the fixing performance. The second fixing device 160 includes a fixing roller 161, a pressure roller 162, and a post-fixing sensor 163. The fixing roller 161 has a configuration similar to that of the fixing roller 151, and functions similarly to the fixing roller 151. The pressure roller 162 functions similarly to the pressure belt 152. The post-fixing sensor 163 functions similarly to the post-fixing sensor 153. The second fixing device 160 performs fixing processing to the sheet 110 similarly to the first fixing device 150.

The second fixing device 160 may not be used depending on the type of the sheet 110 and the content of the image formation processing. A conveyance path 130 is provided in order to convey the sheet 110 subjected to fixing processing by the first fixing device 150 without causing the sheet 110 to pass through the second fixing device 160. Accordingly, a flapper 131 is provided on the downstream of the first fixing device 150 in the conveying direction of the sheet 110. The flapper 131 is used to guide the sheet 110 to any one of the second fixing device 160 and the conveyance path 130.

The sheet 110 that has passed through any one of the second fixing device 160 and the conveyance path 130 is discharged as it is in some cases, and is conveyed to a conveyance path 135 in other cases. Accordingly, a flapper 132 is provided at a position after a junction between a conveyance path following the second fixing device 160 and the conveyance path 130. The flapper 132 is used to guide the sheet 110 to any one of the conveyance path 135 and a discharge path 139. The sheet 110 guided to the discharge path 139 is discharged to the outside of the casing 101 with its surface having the image formed thereon (first surface) facing upward.

The conveyance path 135 is a path for conveying the sheet 110 to a reverse path 136 to be used for reversing the front and back surfaces of the sheet 110. A reverse sensor 137 for detecting the sheet 110 is provided in the reverse path 136. When the reverse sensor 137 detects the trailing edge of the sheet 110, the conveying direction of the sheet 110 is reversed in the reverse path 136. The sheet 110 whose conveying direction is reversed is conveyed to any one of the conveyance path 135 and a reverse path 138. Accordingly, a flapper 133 is provided at a branch of the conveyance path 135 and the reverse path 138. When being conveyed along the conveyance path 135, the sheet 110 is guided by the flapper 133 to the conveyance path 135, and is discharged to the outside of the casing 101 with its front and back surfaces being reversed (surface having the image formed thereon facing downward). When being conveyed to the reverse path 138, the sheet 110 is guided by the flapper 133 to the reverse path 138. The sheet 110 guided to the reverse path 138 is conveyed to the transfer rollers 114 again with its front and back surfaces being reversed. In this manner, image formation is performed on the back surface (second surface) of the sheet 110.

<Adjustment Unit>

Figure 2:
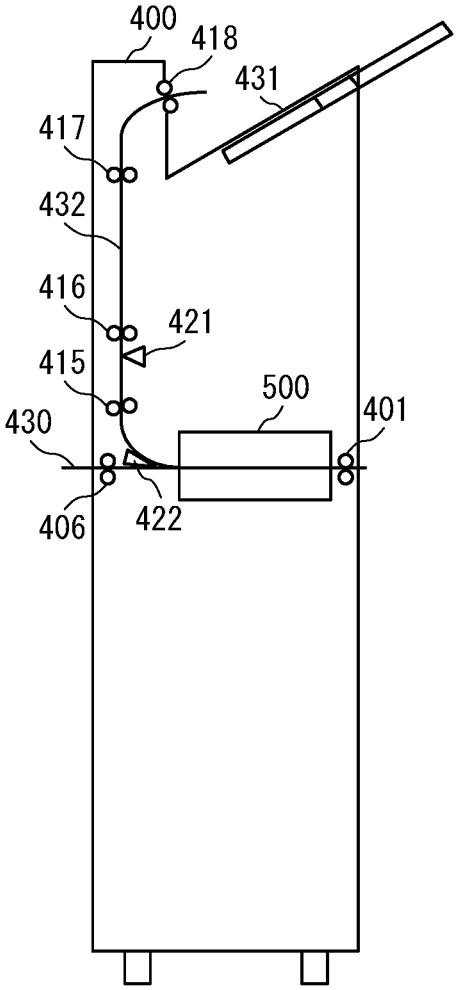
FIG. 2 is a configuration view of an adjustment unit.

FIG. 2 is a configuration view of the adjustment unit 400. The adjustment unit 400 is provided at the subsequent stage of the printer 100, and receives the sheet 110 subjected to image formation and discharged from the printer 100. The adjustment unit 400 includes two conveyance paths of a through-path 430 and a discharge path 432. A branch flapper 422 is provided at a branch point between the through-path 430 and the discharge path 432. In the through-path 430, a reading unit 500 is provided on the upstream side of the branch flapper 422 in the conveying direction of the sheet 110. The reading unit 500 reads an image formed on the sheet 110 received from the printer 100.

In the through-path 430, conveyance rollers 401, the reading unit 500, the branch flapper 422, and discharge rollers 406 are provided in the stated order from the upstream side in the conveying direction of the sheet 110. In the discharge path 432, conveyance rollers 415, 416, and 417 and discharge rollers 418 are provided with the branch flapper 422 being set as a base point. When the sheet 110 passes through the through-path 430, the branch flapper 422 moves to an upper position. The sheet 110 that has passed through the through-path 430 is discharged from the adjustment unit 400 to the outside (finisher 600) by the discharge rollers 406. The finisher 600 discharges the sheet 110 to a tray 601 or a tray 602. The finisher 600 may subject the sheet 110 to post-processing, for example, staple processing and bookbinding processing. When the sheet 110 is conveyed to the discharge path 432, the branch flapper 422 moves to a lower position. The sheet 110 conveyed to the discharge path 432 is discharged to a fixed tray 431 by the discharge rollers 418.

In this manner, the discharge destination of the sheet 110 can be switched by the branch flapper 422. The sheet 110 to be conveyed to the finisher 600 passes through the through-path 430. The sheet 110 to be used for front/back registration has an image read by the reading unit 500, and the sheet 110 is discharged to the fixed tray 431 through the discharge path 432. The sheet 110 on which an image is formed based on a job may be referred to as a "job sheet," and the sheet 110 to be used for the front/back registration may be referred to as an "adjustment sheet." The job sheet is conveyed to the finisher 600 through the through-path 430.

It is possible to prevent the adjustment sheet from being mixed between the job sheets by discharging the job sheet and the adjustment sheet separately from each other. No adjustment sheet is required for the user. When the adjustment sheet is mixed between the job sheets, work for removing the adjustment sheet occurs. Therefore, it is effective to discharge the job sheet and the adjustment sheet separately from each other in order to improve the efficiency of user work.

<Reading Unit>

Figure 3A:
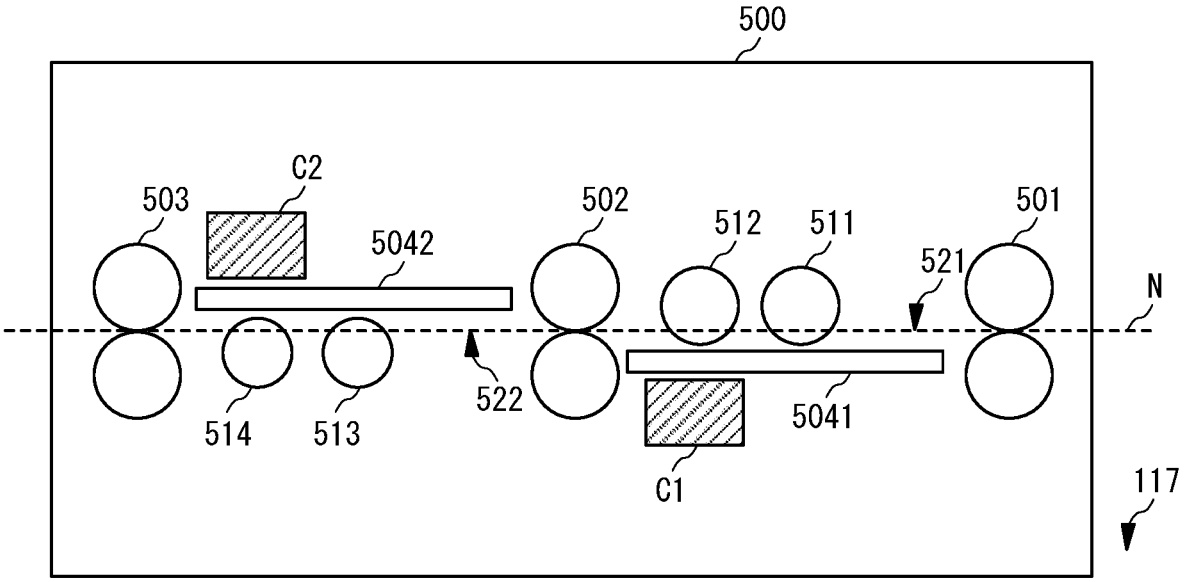
FIG. 3A and FIG. 3B are explanatory views of a reading unit.
Figure 3B:
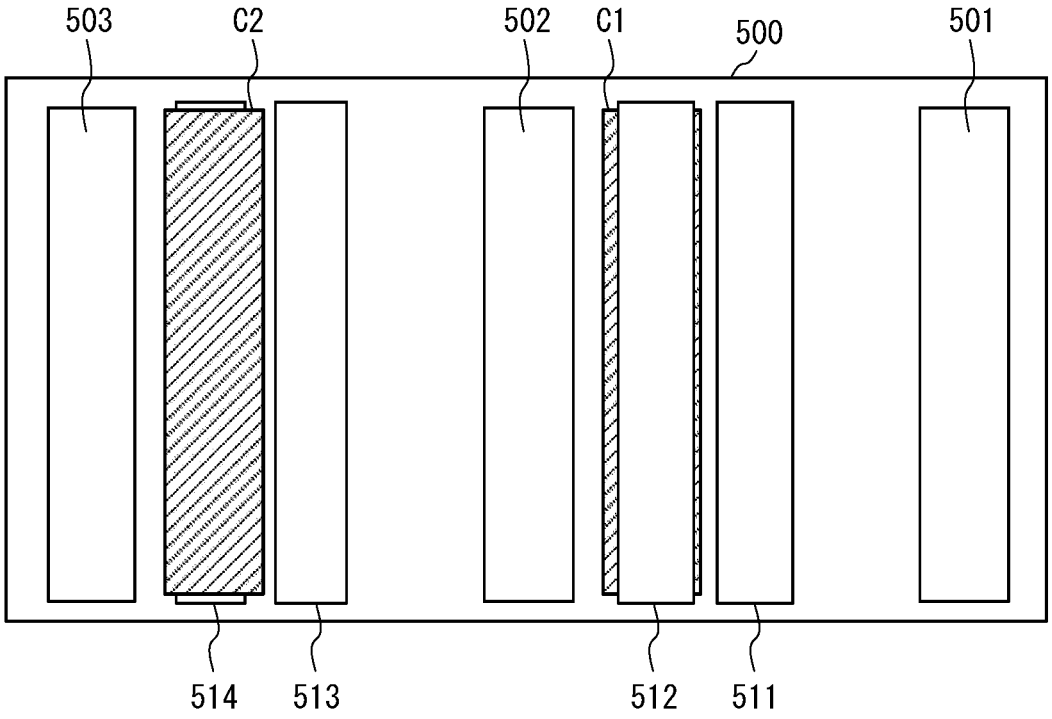

FIG. 3A and FIG. 3B are explanatory views of the reading unit 500. FIG. 3A is a cross-sectional view of the reading unit 500. FIG. 3B is a top view of the reading unit 500. The reading unit 500 includes conveyance rollers 501, 502, and 503, reading sensors C1 and C2, glasses 5041 and 5042, bias rollers 511, 512, 513, and 514, and sheet detection sensors 521 and 522.

The conveyance rollers 501, 502, and 503 convey the sheet 110. The sheet 110 is conveyed through the conveyance roller 501, the conveyance roller 502, and the conveyance roller 503 in the stated order. The reading sensors C1 and C2 detect an edge portion of the sheet 110 being conveyed, and read the printed image. The reading sensors C1 and C2 are optical sensors, for example, contact image sensors (CISes). The reading sensor C1 reads an image on the back surface of the sheet 110. The reading sensor C2 reads an image on the front surface of the sheet. The reading sensors C1 and C2 continuously read images line by line with a direction perpendicular to the conveying direction of the sheet 110 being used as a main scanning direction. The conveying direction of the sheet 110 is used as a sub-scanning direction.

The sheet detection sensors 521 and 522 detect the sheet 110 being conveyed. An operation timing of the reading sensor C1 is determined based on a timing at which the sheet detection sensor 521 detects the sheet 110. An operation timing of the reading sensor C2 is determined based on a timing at which the sheet detection sensor 522 detects the sheet 110. The sheet detection sensor 521 may be arranged at any position between an inlet through which the adjustment unit 400 receives the sheet 110 from the printer 100 and a reading position of the reading sensor C1. The sheet detection sensor 522 may be arranged at any position between the reading position of the reading sensor C1 and a reading position of the reading sensor C2. The operation timing of the reading sensor C2 may also be determined based on the timing at which the sheet detection sensor 521 detects the sheet without providing the sheet detection sensor 522.

The reading sensor C1 irradiates the sheet 110 being conveyed with light through the glass 5041, and receives the reflected light through the glass 5041, to thereby detect the edge portion of the sheet 110 and read the image. The bias rollers 511 and 512 are arranged so as to face the reading sensor C1, and bias the sheet 110 toward the reading sensor C1 side. The bias rollers 511 and 512 are arranged with a predetermined gap from the glass 5041. That is, the bias rollers 511 and 512 and the glass 5041 do not contribute to the formation of a nip. The bias rollers 511 and 512 cross a nip line N connecting nip portions of the conveyance rollers 501, 502, and 503 toward the glass 5041 side. Thus, the sheet 110 passes through a position closer to the glass 5041, that is, near a focus position of the reading sensor C1. When the reading sensor C1 is a CIS, the depth of focus of the CIS is small, and hence it is required to bias the sheet 110 toward a position near the focus position of the reading sensor C1.

The reading sensor C2 irradiates the sheet 110 being conveyed with light through the glass 5042, and receives the reflected light through the glass 5042, to thereby detect the edge portion of the sheet 110 and read the image. The bias rollers 513 and 514 are arranged so as to face the reading sensor C2, and bias the sheet 110 toward the reading sensor C2 side. The bias rollers 513 and 514 are arranged with a predetermined gap from the glass 5042. That is, the bias rollers 513 and 514 do not form a nip with the glass 5042. The bias rollers 513 and 514 cross the nip line N toward the glass 5042 side. Thus, the sheet 110 passes through a position closer to the glass 5042, that is, near a focus position of the reading sensor C2. When the reading sensor C2 is a CIS, the depth of focus of the CIS is small, and hence it is required to bias the sheet 110 toward a position near the focus position of the reading sensor C2.

The reading unit 500 having such a configuration can read the edge portion of the sheet 110 and the image formed on the sheet 110 while conveying the sheet 110 by the conveyance rollers 501, 502, and 503. A distance from the edge of the sheet 110 to the image is detected based on a reading result obtained by the reading unit 500. The distance from the edge of the sheet 110 to the image is used to perform geometric adjustment, for example, adjustment of a formation position (printing position) of the image on the sheet 110. The components of the reading sensor C1, the glass 5041, and the bias rollers 511 and 512 may be reversed from the components of the reading sensor C2, the glass 5042, and the bias rollers 513 and 514 in terms of the arrangement. That is, the components of the reading sensor C2, the glass 5042, and the bias rollers 513 and 514 may be arranged on the upstream side, and the components of the reading sensor C1, the glass 5041, and the bias rollers 511 and 512 may be arranged on the downstream side.

Figure 4:
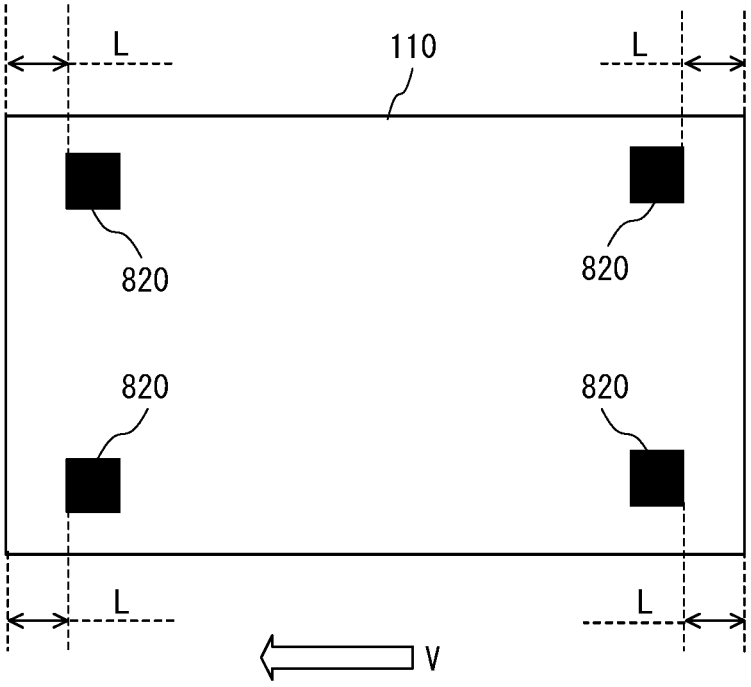
FIG. 4 is an explanatory view of an adjustment sheet.

FIG. 4 is an explanatory view of the sheet 110 (adjustment sheet) to be used for adjusting the printing position. The adjustment sheet is created by printing a test image formed of four patch images 820 in the vicinity of the four vertices of the sheet 110. The patch image 820 on the leading edge side of the sheet 110 in the conveying direction is printed at a position at which the distance from the leading edge portion of the sheet 110 in the conveying direction is L. The patch image 820 on the trailing edge side of the sheet 110 in the conveying direction is printed at a position at which the distance from the trailing edge portion of the sheet 110 in the conveying direction is L. When the conveying speed of the sheet 110 is represented by V, a timing at which the reading sensor detects an edge portion of the sheet is represented by T1, and a timing at which the reading sensor detects an edge portion of the patch image 820 edge portion is represented by T2, the distance L is expressed as L=(T2−T1)*V. In this case, any one of the reading sensor C1 or the reading sensor C2 can be used as the reading sensor.

<Controller>

Figure 5:
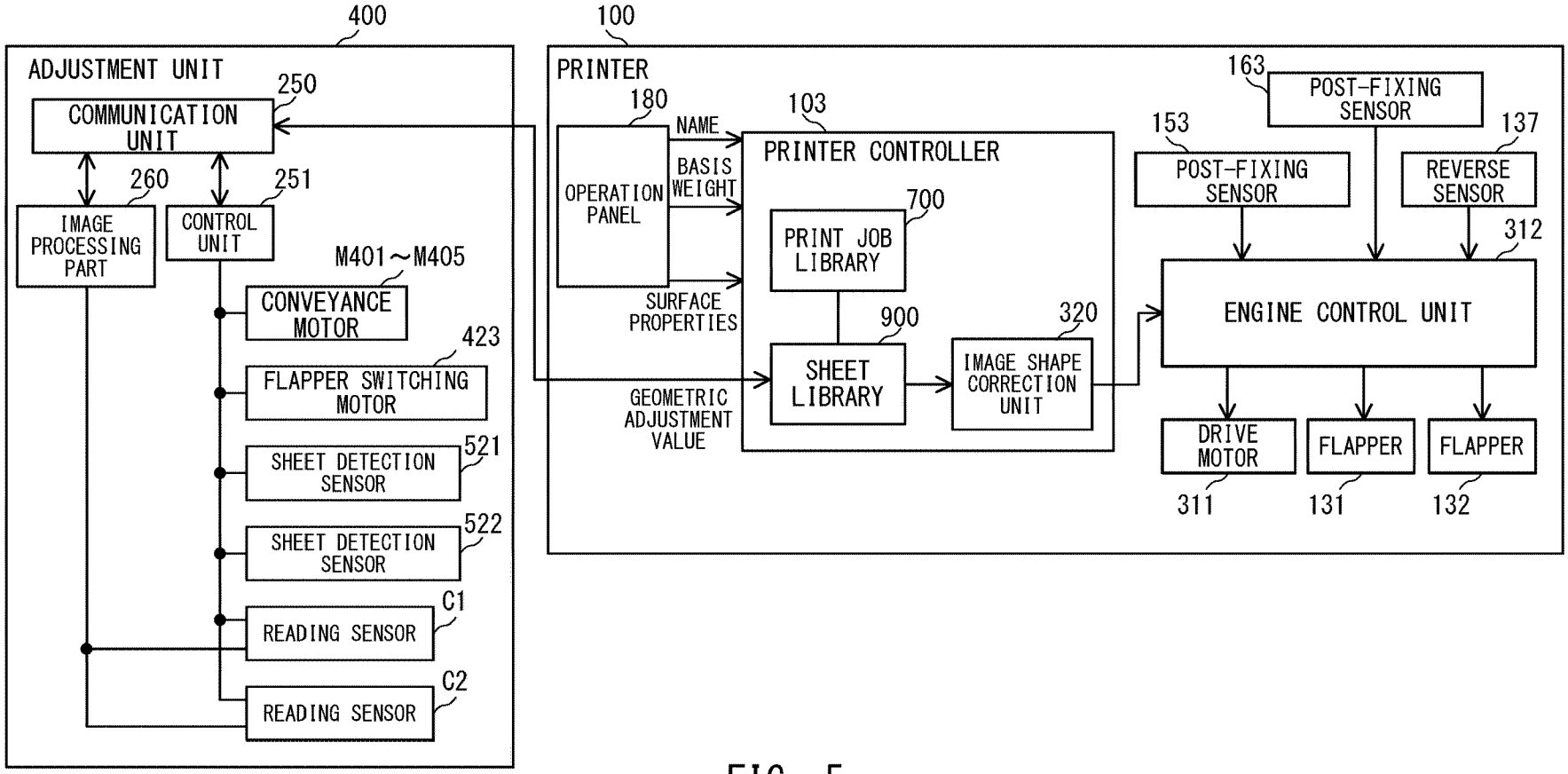
FIG. 5 is an explanatory diagram of a controller.

FIG. 5 is an explanatory diagram of a controller for controlling an operation of the image forming apparatus 1. The printer 100 includes a printer controller 103 and an engine control unit 312. The printer controller 103 comprehensively controls the operation of the image forming apparatus 1. The engine control unit 312 controls image forming processing on the sheet 110 by controlling an operation of each of the mechanisms which form the engine unit for use in the image formation.

Figure 6A:
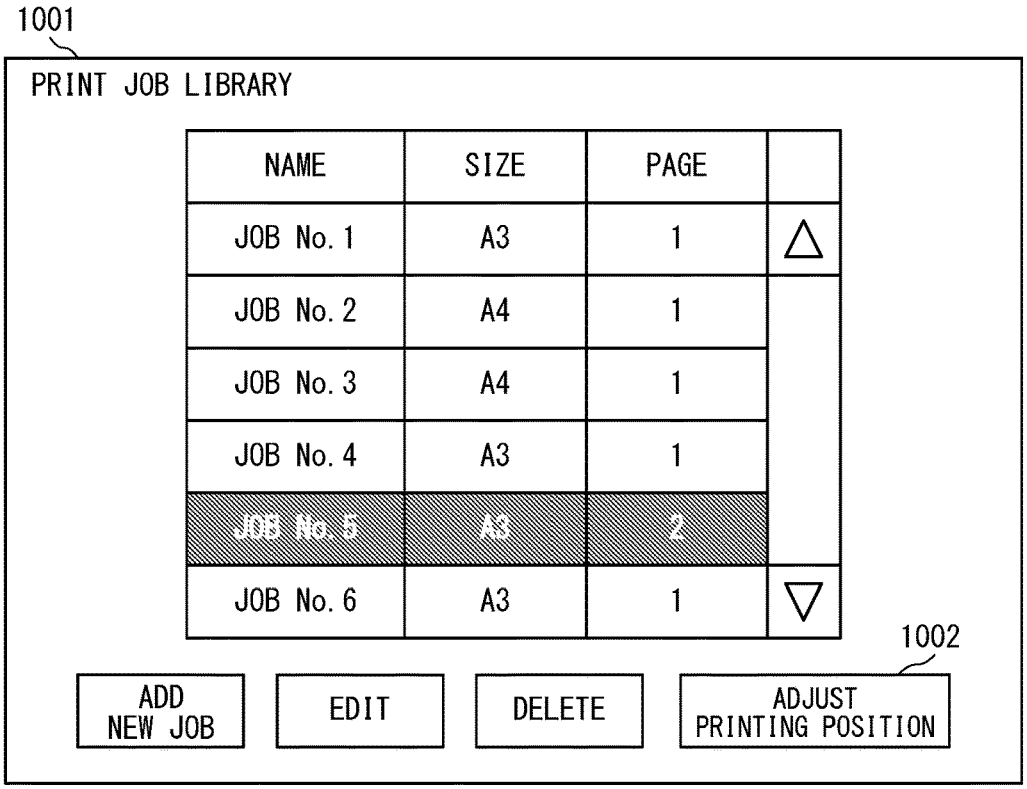
FIG. 6A and FIG. 6B are exemplary views of an operation screen.
Figure 6B:
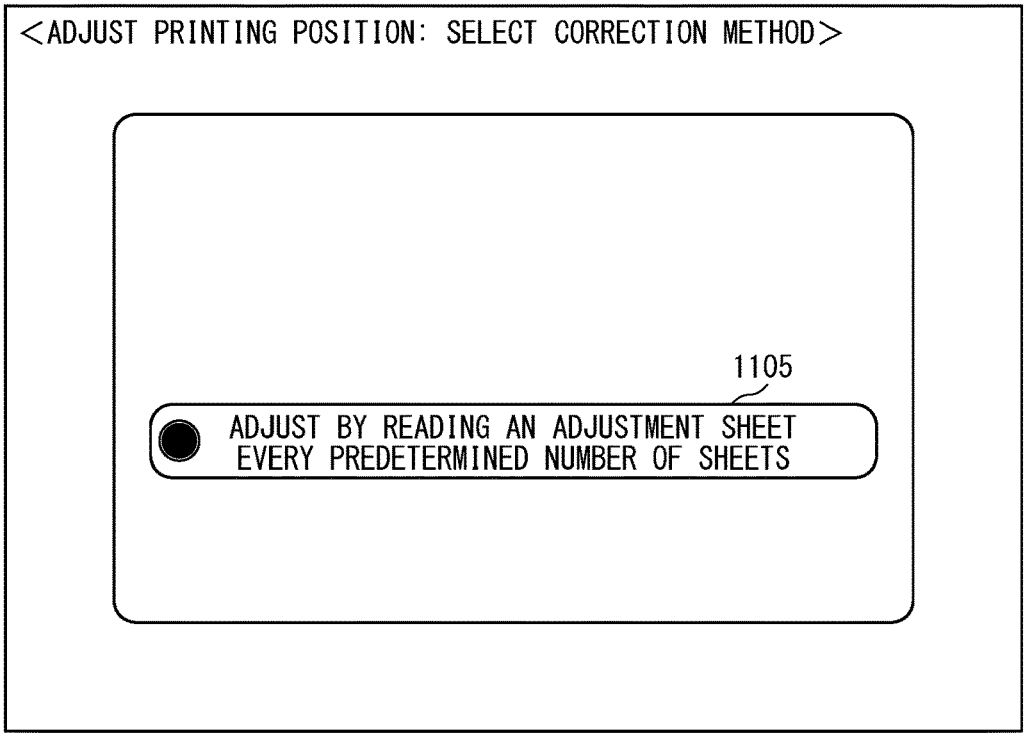

The printer controller 103 is connected to the operation panel 180, and acquires, for example, instructions input from the operation panel 180 to cause the operation panel 180 to display various screens including such operation screens as illustrated as examples in FIG. 6A and FIG. 6B. The printer controller 103 includes a print job library 700, a sheet library 900, and an image shape correction unit 320. The print job library 700 and the sheet library 900 are linked to each other. In this case, for example, a print job including image data transferred from a personal computer serving as an external device is stored in the print job library 700. In the following description, an image formed by the image forming apparatus 1 based on the print job is referred to as a "user image." The user image is an image different from the test image determined in advance.

The print job library 700 stores print jobs input from the operation panel 180. The print job library 700 stores, for each of the print jobs, information including the dimensions (sheet size) of the sheet to be used for printing and the number of pages to be printed. The sheet library 900 stores information including geometric characteristics of an image to be formed on a sheet for each type of sheets that can be used by the printer 100. The information on the geometric characteristics of an image to be formed on the sheet is updated based on geometric adjustment values acquired from the adjustment unit 400 as described later. The information stored in the sheet library 900 also includes information including the name, basis weight, and surface properties of the sheet that are input from the operation panel 180. The image shape correction unit 320 acquires the information on the geometric characteristics of the sheet to be used in the print job from the sheet library 900, and controls the image shape, printing position, and other geometric characteristics of an image to be formed on the sheet based on the acquired information on the geometric characteristics. The image data corrected by the image shape correction unit 320 is transmitted to the engine control unit 312.

Post-fixing sensors 153 and 163, a reverse sensor 137, flappers 131 and 132, a drive motor 311, and other components are connected to the engine control unit 312. The drive motor 311 is a drive source for driving various rollers for conveying the sheet 110 in the printer 100. The engine control unit 312 forms an image onto the sheet 110 by each mechanism of the engine unit in accordance with a print instruction including image data, which is given by the printer controller 103. At this time, the engine control unit 312 performs conveyance control on the sheet 110 by controlling operations of the flappers 131 and 132, the drive motor 311, and other components based on detection results obtained by the sensors including the post-fixing sensors 153 and 163 and the reverse sensor 137.

The adjustment unit 400 is connected to the printer 100 so as to enable communication therebetween. The adjustment unit 400 includes a communication unit 250, a control unit 251, and an image processing part 260. Conveyance motors M401 to M405, a flapper switching motor 423, the sheet detection sensors 521 and 522, and the reading sensors C1 and C2 are connected to the control unit 251. The reading sensors C1 and C2 are connected to the image processing part 260.

The communication unit 250 is a communication interface with respect to the printer 100 (printer controller 103). The communication unit 250 receives data from the printer controller 103 to transmit the data to the control unit 251 and the image processing part 260. The communication unit 250 receives data from the control unit 251 and the image processing part 260 to transmit the data to the printer controller 103. For example, the communication unit 250 receives an operation instruction from the printer controller 103 to transmit the operation instruction to the control unit 251, and acquires a geometric adjustment value described later from the image processing part 260 to transmit the geometric adjustment value to the printer controller 103.

The control unit 251 operates in accordance with the operation instruction acquired from the printer controller 103 to control operations of the conveyance motors M401 to M405, the flapper switching motor 423, and the reading sensors C1 and C2. The conveyance motors M401 to M405 are drive sources for the conveyance rollers 401, 415, 416, 417, 501, 502, and 503, the discharge rollers 406 and 418, and the bias rollers 511, 512, 513, and 514 which are included in the adjustment unit 400. The conveyance motors M401 to M405 convey the sheet 110 by driving and controlling those rollers in accordance with the instructions given by the control unit 251.

The flapper switching motor 423 performs switching control on the branch flapper 422 in accordance with the instruction given by the control unit 251. The operation instruction acquired from the printer controller 103 by the control unit 251 includes information indicating whether the image formed on the delivered sheet 110 is a user image corresponding to the print job or a test image. When the user image corresponding to the print job is formed on the delivered sheet 110 (in the case of a job sheet), the control unit 251 causes the flapper switching motor 423 to move the branch flapper 422 to the upper position. When a test image is formed on the delivered sheet 110 (in the case of an adjustment sheet), the control unit 251 causes the flapper switching motor 423 to move the branch flapper 422 to the lower position.

The reading sensors C1 and C2 each read an image from the sheet 110 in accordance with the instruction given by the control unit 251. When the delivered sheet is an adjustment sheet, the control unit 251 instructs each of the reading sensors C1 and C2 to read the image. The control unit 251 is also connected to the sheet detection sensors 521 and 522, and instructs each of the reading sensors C1 and C2 to read the image formed on the sheet 110 based on a timing at which each of the sheet detection sensors 521 and 522 detects the sheet 110. The reading sensors C1 and C2 each transmit a reading result of the sheet 110 to the image processing part 260.

The image processing part 260 operates in accordance with the instruction acquired from the printer controller 103, and generates geometric adjustment values for adjusting the geometric characteristics of an image to be formed by the printer 100 based on the reading results of the sheet 110 obtained by the reading sensors C1 and C2. Examples of the geometric characteristics include the shape and printing position of an image to be formed on the sheet 110. The image processing part 260 stores the generated geometric adjustment values in the sheet library 900 of the printer controller 103 through the communication unit 250.

Figure 7:
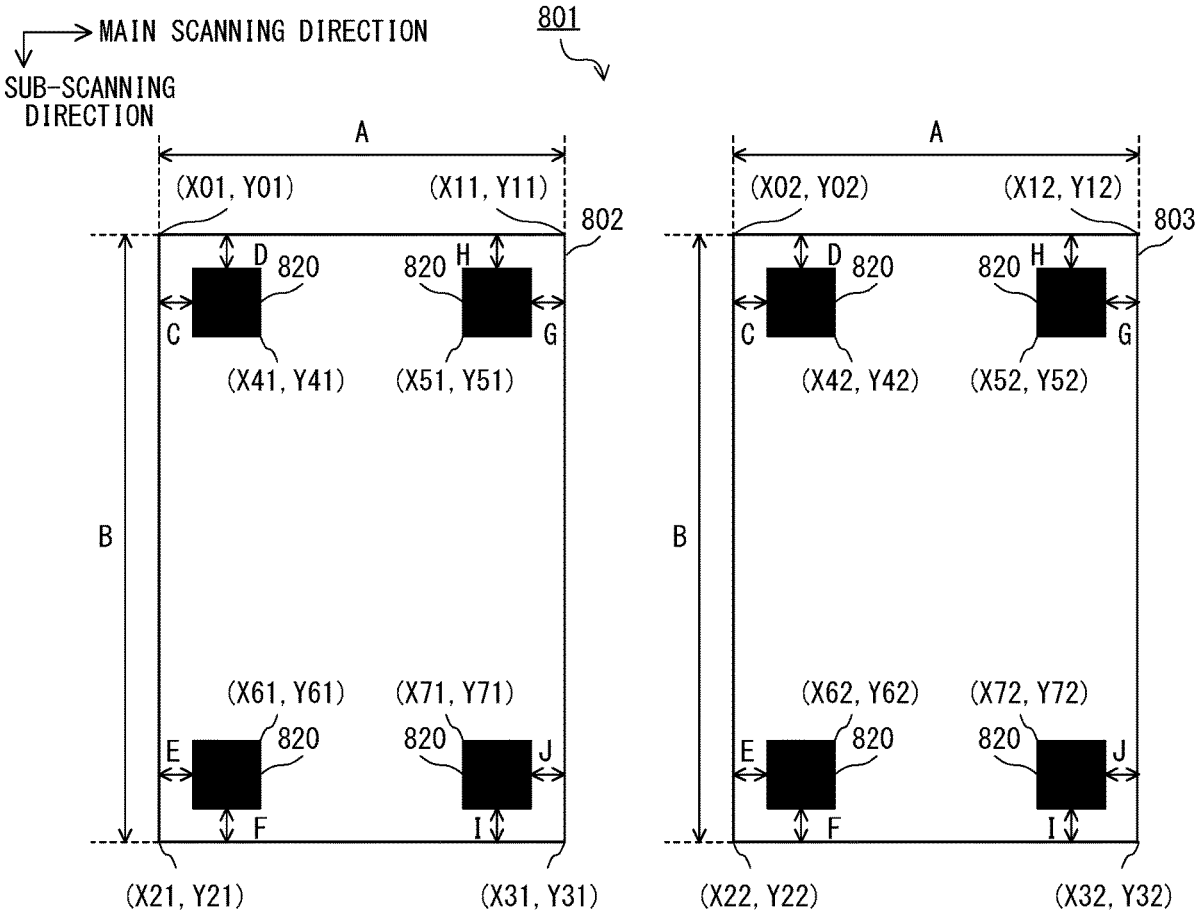
FIG. 7 is an exemplary view of the adjustment sheet.

Processing for adjusting the geometric characteristics by the controller of the image forming apparatus 1 as described above is described. In this case, a case in which the printing position is adjusted as a geometric characteristic is described. The geometric characteristic is adjusted by forming images on the sheets 110 of a predetermined number. That is, the geometric characteristic is periodically adjusted every time the number of sheets 110 passed in the image forming apparatus 1 reaches the predetermined number. An adjustment sheet 801 illustrated as an example in FIG. 7 is used for adjusting the geometric characteristic. Therefore, the adjustment sheet 801 is created every time a periodic condition is satisfied (every time the number of passed sheets 110 reaches the predetermined number). The predetermined number of sheets being the condition for periodically creating the adjustment sheet 801 is determined based on, for example, user instruction information. The printer controller 103 acquires the user instruction information relating to the periodic condition for periodically creating the adjustment sheet 801 input from the operation panel 180, and determines the predetermined number of sheets based on the user instruction information.

The printer controller 103 displays a list screen 1001 for print jobs illustrated as an example in FIG. 6A on the operation panel 180 based on the print jobs stored in the print job library 700. The user uses the operation panel 180 to select an "ADJUST PRINTING POSITION" button 1002 on the list screen 1001. Thus, the printer controller 103 displays a printing position adjustment screen illustrated as an example in FIG. 6B on the operation panel 180. The user uses the operation panel 180 to put a check on an item "ADJUST BY READING AN ADJUSTMENT SHEET EVERY PREDETERMINED NUMBER OF SHEETS" 1105 on the printing position adjustment screen. When a check is put on the item 1105, the printer controller 103 instructs the engine control unit 312 to form an adjustment sheet for front/back registration. The engine control unit 312 creates an adjustment sheet for each predetermined number of sheets in accordance with this instruction.

In the adjustment sheet 801 illustrated as an example in FIG. 7, the test image 802 formed of four patch images 820 as illustrated as an example in FIG. 4 is formed on the front surface of the sheet 110, and a test image 803 formed of four patch images 820 as illustrated as an example in FIG. 4 is formed on the back surface of the sheet 110. The adjustment sheet 801 is delivered from the printer 100 to the adjustment unit 400. The adjustment sheet 801 is created by interrupting a print job for forming a user image every time images have been formed on the sheets 110 of a predetermined number of sheets in the print job.

The reading unit 500 of the adjustment unit 400 continuously reads the patch images 820 on both sides line by line by the reading sensors C1 and C2 while the adjustment sheet 801 is being conveyed by the conveyance rollers 501, 502, and 503. The image processing part 260 acquires reading results for each line from the reading sensors C1 and C2 and joins the reading results, to thereby generate read images on both sides of the adjustment sheet 801. The adjustment sheet 801 read by the reading sensors C1 and C2 is discharged to the fixed tray 431 through the discharge path 432.

From the read image of the front surface (test image 802) of the adjustment sheet 801, the image processing part 260 detects vertex coordinates (X01, Y01), (X11, Y11), (X21, Y21), and (X31, Y31) of the sheet and coordinates (X41, Y41), (X51, Y51), (X61, Y61), and (X71, Y71) of the patch images 820. From the read image of the back surface (test image 803) of the adjustment sheet 801, the image processing part 260 detects vertex coordinates (X02, Y02), (X12, Y12), (X22, Y22), and (X32, Y32) of the sheet and coordinates (X42, Y42), (X52, Y52), (X62, Y62), and (X72, Y72) of the patch images 820.

The image processing part 260 measures, for example, a distortion amount of the image on the front surface and the print misregistration on the sheet 110 based on the detected vertex coordinates (X01, Y01), (X11, Y11), (X21, Y21), and (X31, Y31) and the detected coordinates (X41, Y41), (X51, Y51), (X61, Y61), and (X71, Y71). The image processing part 260 measures, for example, a distortion amount of the image on the back surface and the print misregistration on the sheet 110 based on the detected vertex coordinates (X02, Y02), (X12, Y12), (X22, Y22), and (X32, Y32) and the detected coordinates (X42, Y42), (X52, Y52), (X62, Y62), and (X72, Y72). The image processing part 260 also measures the print misregistration on the front and back surfaces based on each of the printing positions on the front surface and the back surface.

The image processing part 260 derives geometric adjustment values for each of the front surface and the back surface, which enable the shape of the image to be corrected by the image shape correction unit 320, based on measurement results of, for example, the distortion amount of the image, the print misregistration, and the print misregistration on the front and back surfaces. The geometric adjustment values include parameters, for example, a leading position, a side position, a magnification, perpendicularity, and a rotation amount. The geometric adjustment values for the front surface and the back surface derived by the image processing part 260 are transmitted to the sheet library 900 of the printer controller 103 through the communication unit 250. The sheet library 900 stores the acquired geometric adjustment values for the front surface and the back surface as the parameters to be used at the time of image formation for the front surface and for the back surface. The geometric adjustment values are derived for each type of the sheet 110 and stored in the sheet library 900.

The image shape correction unit 320 transmits the image data adjusted based on the geometric adjustment values to the engine control unit 312. The engine control unit 312 forms images on the sheet 110 based on the adjusted image data. The images formed in this manner are formed on both sides of the sheet 110 while the image position, distortion, and other geometrical characteristics have been adjusted with high-precision front/back registration.

Through the updating of the geometric adjustment values, the geometric characteristics of the images formed on the sheet 110 are maintained with high precision. In this embodiment, the geometric adjustment values are updated not only at a predetermined timing in the middle of the print job but also before the start of the print job. That is, the adjustment sheet 801 is created before the start of the print job as well as created by interrupting the print job in the middle thereof.

<Front/Back Registration>

Figure 8:
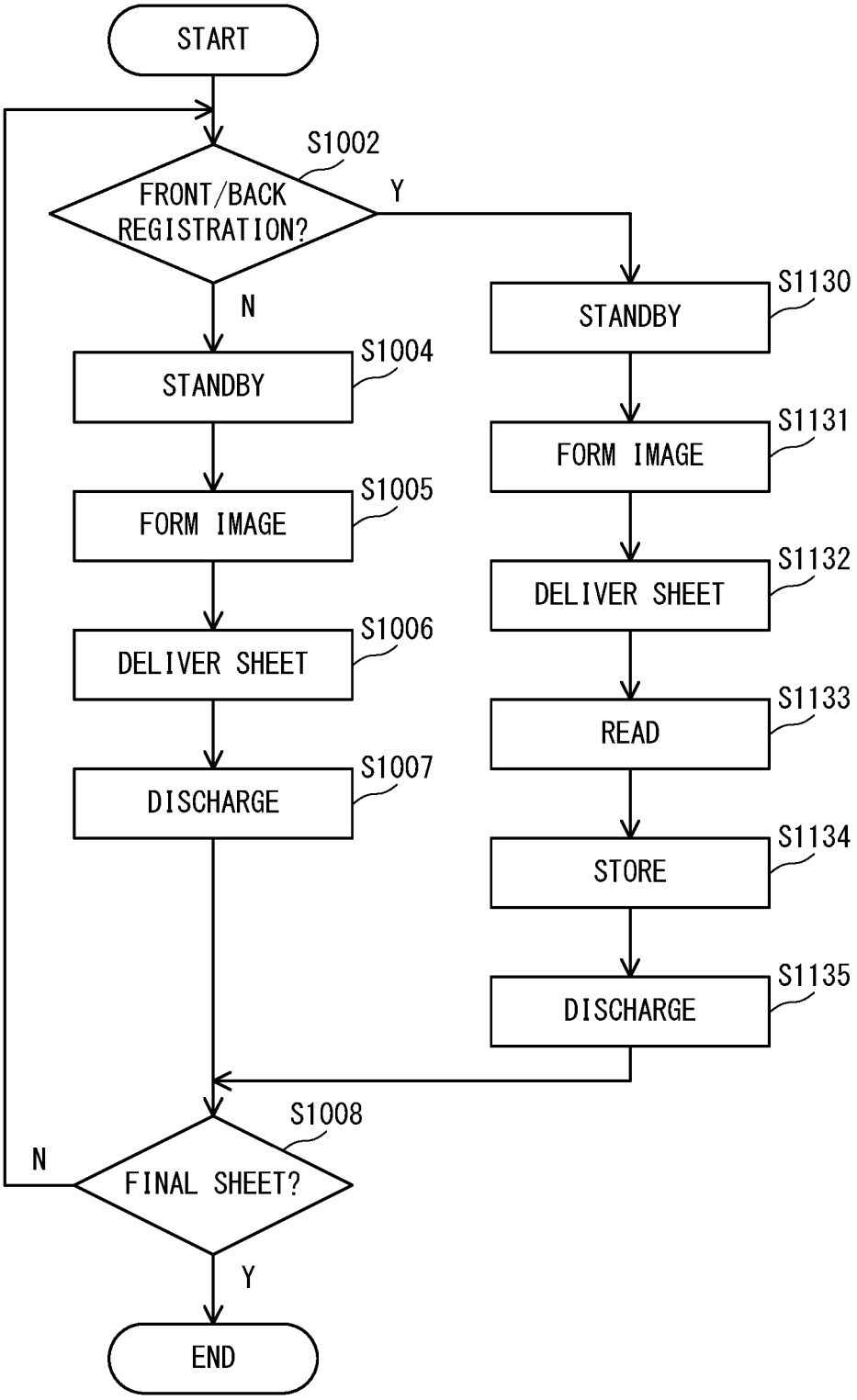
FIG. 8 is a flow chart for illustrating front/back registration processing.
Figure 9A:
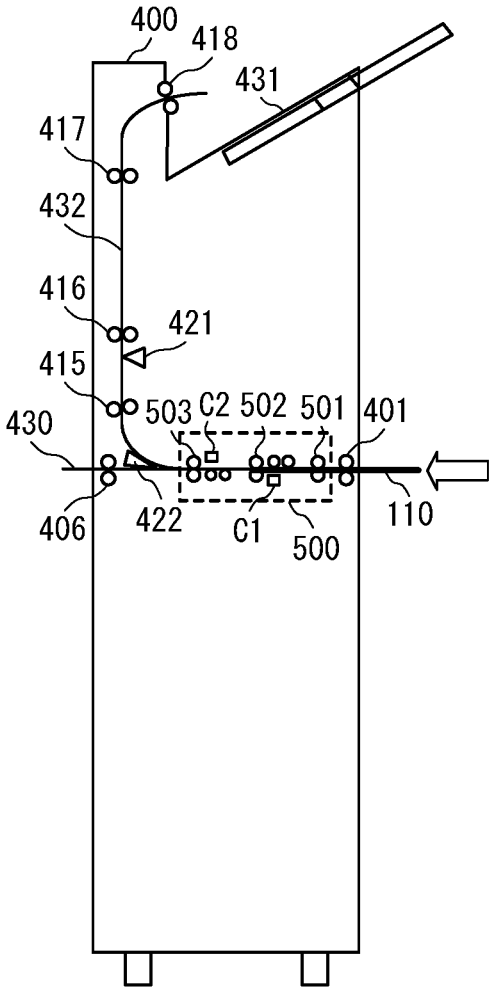
FIG. 9A and FIG. 9B are explanatory views of a position of a job sheet in the adjustment unit.
Figure 9B:
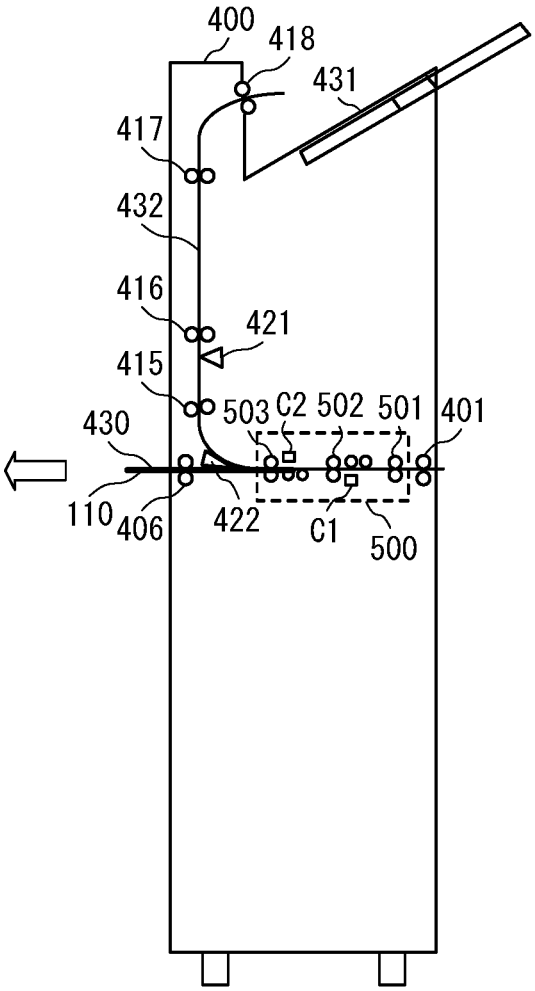
Figure 10A:
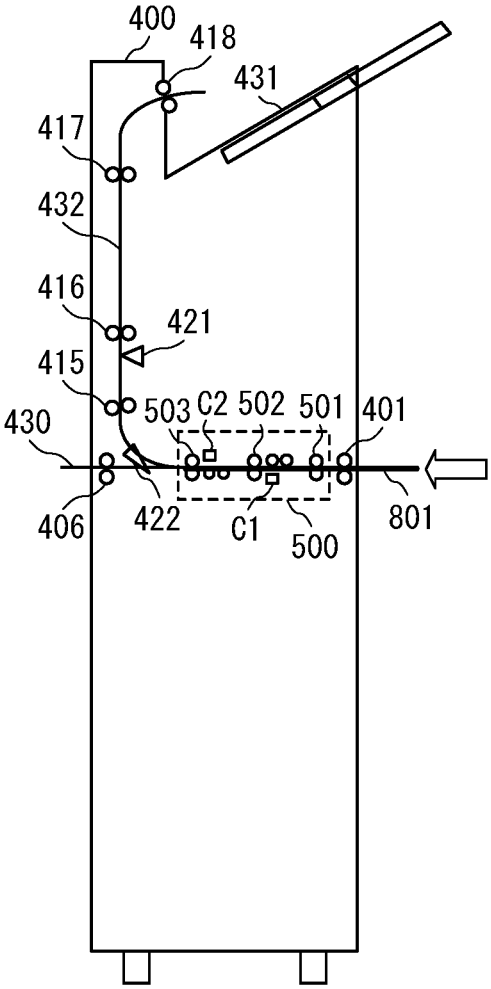
FIG. 10A and FIG. 10B are explanatory views of a position of the adjustment sheet in the adjustment unit.
Figure 10B:
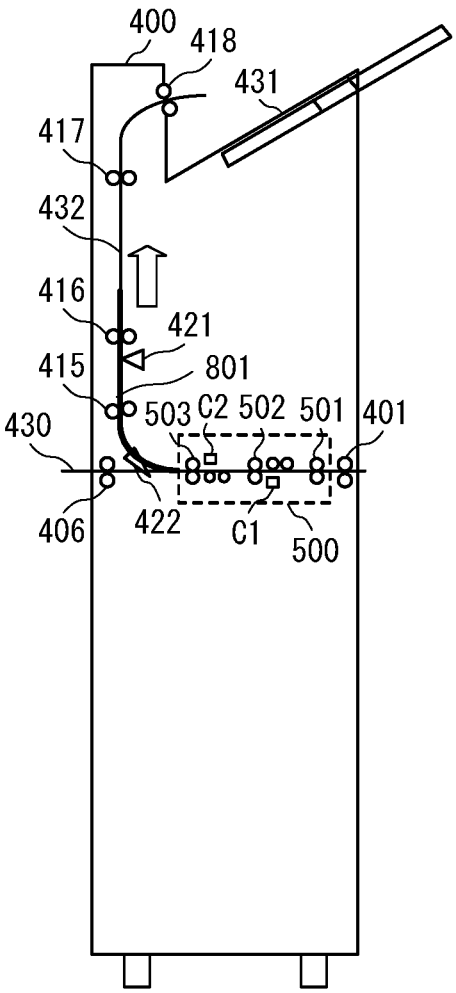

FIG. 8 is a flow chart for illustrating front/back registration processing to be performed by the image forming apparatus 1. FIG. 9A and FIG. 9B are explanatory views of the position of the job sheet in the adjustment unit 400. FIG. 10A and FIG. 10B are explanatory views of the position of the adjustment sheet 801 in the adjustment unit 400. The image forming apparatus 1 receives a print job and starts processing. When the "ADJUST PRINTING POSITION" button 1002 on the list screen 1001 of FIG. 6A is selected, the image forming apparatus 1 performs the front/back registration by interrupting the print job even in the middle thereof.

The printer controller 103 determines whether or not to perform the front/back registration (Step S1002). The printer controller 103 performs this determination when the "ADJUST PRINTING POSITION" button 1002 is selected. The printer controller 103 counts the number of sheets 110 for which images have been formed based on the print job, and determines that the front/back registration is to be performed when the count value reaches a predetermined number of sheets.

When the front/back registration is not to be performed (N in Step S1002), each of the components included in the printer 100 and the adjustment unit 400 stands by at each home position (Step S1004). At this time, the branch flapper 422 included in the adjustment unit 400 has been moved to the upper position in order to guide the sheet 110 to the through-path 430.

The printer controller 103 instructs the engine control unit 312 to form an image based on the print job. The engine control unit 312 forms the image on the sheet 110 in accordance with this instruction (Step S1005). At this time, when a geometric adjustment value is stored in the sheet library 900, the image shape correction unit 320 performs image processing on the image data based on the geometric adjustment value. The image processing for adjusting the geometric characteristics of the image is, for example, affine transformation of the image. Thus, the geometrically adjusted image is formed on the sheet 110. The printer 100 delivers the sheet 110 (job sheet) on which the image has been formed to the adjustment unit 400 (Step S1006). FIG. 9A indicates how the sheet 110 is delivered from the printer 100 to the adjustment unit 400. At this time, the printer controller 103 increments the number of sheets 110 subjected to the image formation by one.

The control unit 251 of the adjustment unit 400 causes the conveyance motors M401 to M405 to drive the conveyance rollers 401, 501, 502, and 503 and the discharge rollers 406 to discharge the sheet 110 (job sheet) to the finisher 600 (Step S1007). FIG. 9B indicates how the sheet 110 (job sheet) is conveyed through the through-path 430 by the conveyance rollers 401, 501, 502, and 503 and the discharge rollers 406 to be discharged to the finisher 600. The finisher 600 discharges the sheet 110 (job sheet) conveyed from the adjustment unit 400 to the tray 601 or the tray 602. In the case of the print job for forming a user image, the image is formed on one sheet 110 in this manner.

When the front/back registration is to be performed (Y in Step S1002), each of the components included in the printer 100 and the adjustment unit 400 stands by at each home position (Step S1130). At this time, the branch flapper 422 included in the adjustment unit 400 has been moved to the lower position in order to guide the sheet 110 to the discharge path 432. The printer controller 103 selects the type of sheet for which the front/back registration is to be performed based on the print job being executed. The printer controller 103 causes the test images 802 and 803 to be formed on the sheet 110 of the same type as that of the sheet 110 on which the user image is being formed.

The printer controller 103 instructs the engine control unit 312 to create the adjustment sheet 801. When the engine control unit 312 receives this instruction, the engine control unit 312 causes the printer 100 to form the test images 802 and 803 on the front and back surfaces of the sheet 110, respectively (Step S1131). The printer 100 delivers the created adjustment sheet 801 to the adjustment unit 400 (Step S1132). FIG. 10A indicates how the adjustment sheet 801 is delivered from the printer 100 to the adjustment unit 400.

The control unit 251 of the adjustment unit 400 causes the conveyance motors M401 to M405 to drive the conveyance rollers 401, 501, 502, and 503 to convey the adjustment sheet 801. Thus, the adjustment sheet 801 passes through the reading position of the reading unit 500. While the adjustment sheet 801 is passing through the reading position of the reading unit 500, the reading sensors C1 and C2 read the test images 802 and 803 formed on both sides (Step S1133). At that time, the control unit 251 starts to read and measure the back surface of the adjustment sheet 801 by the reading sensor C1 after a predetermined time period has elapsed since a timing at which the sheet detection sensor 521 detected the leading edge of the adjustment sheet 801. The control unit 251 also starts to read and measure the front surface of the adjustment sheet 801 by the reading sensor C2 after a predetermined time period has elapsed since a timing at which the sheet detection sensor 522 detected the leading edge of the adjustment sheet 801.

As described above, the image processing part 260 derives geometric adjustment values based on the reading results of the adjustment sheet 801 obtained by the reading sensors C1 and C2, and stores the geometric adjustment values in the sheet library 900 (Step S1134). The geometric adjustment values bring the printing position adjustment for the front/back registration to completion. When the printing position adjustment is completed, the control unit 251 causes the conveyance motors M401 to M405 to drive the conveyance rollers 415, 416, and 417 and the discharge rollers 418 to discharge the adjustment sheet 801 to the fixed tray 431 (Step S1135). FIG. 10B indicates how the adjustment sheet 801 is conveyed through the discharge path 432 by the conveyance rollers 415, 416, and 417 and the discharge rollers 418.

When the sheet 110 (job sheet) or the adjustment sheet 801 is discharged, the printer controller 103 determines whether or not the image forming processing has been completed on the final sheet corresponding to the print job for forming a user image (Step S1008). When the image forming processing has not been completed on the final sheet (N in Step S1008), the image forming apparatus 1 repeatedly performs the processing step of Step S1002 and the subsequent steps. When the image forming processing on the final sheet has been completed (Yin Step S1008), the image forming apparatus 1 ends the front/back registration processing.

Figure 11A:
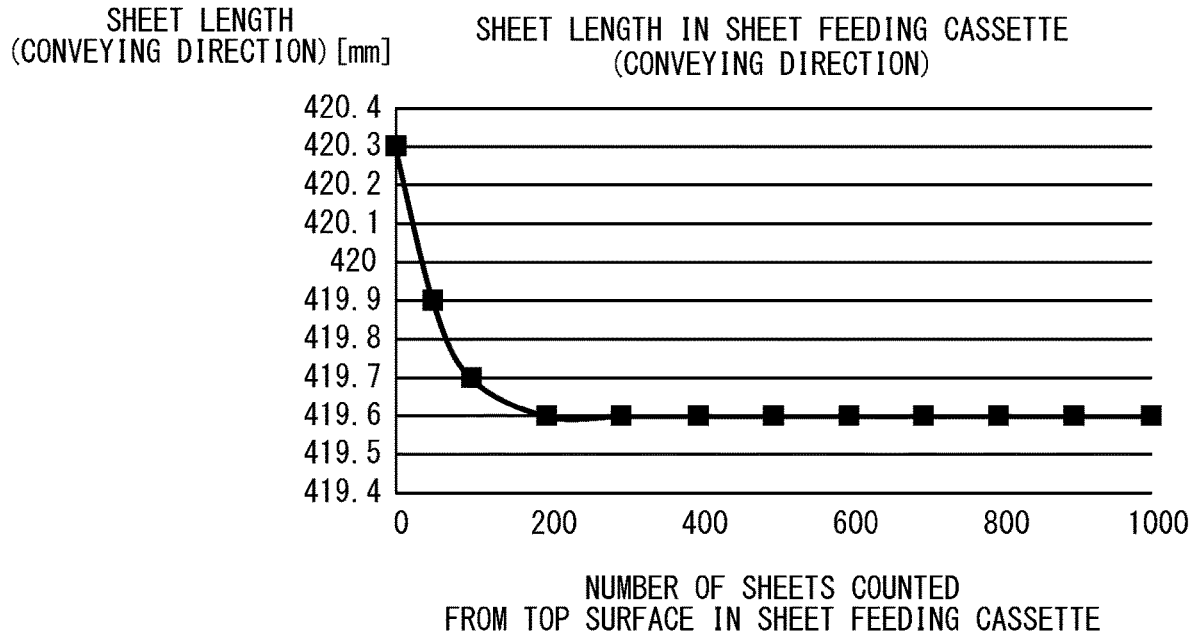
FIG. 11A and FIG. 11B are explanatory graphs of a relationship between a transition of a length of a sheet in a conveying direction thereof and a front/back misregistration amount.
Figure 11B:
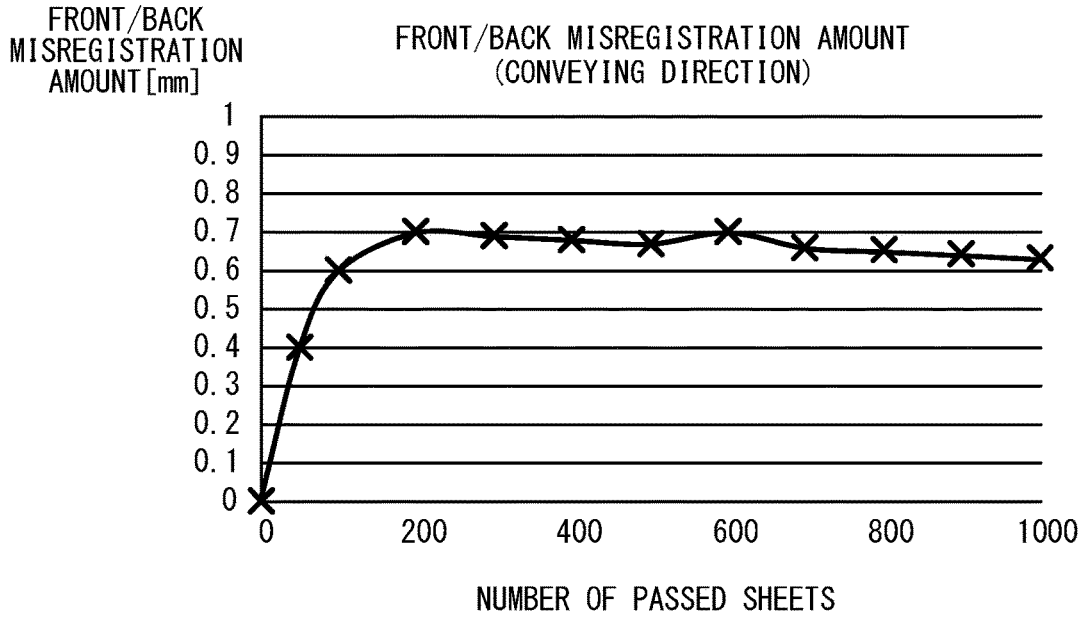
Figure 12:
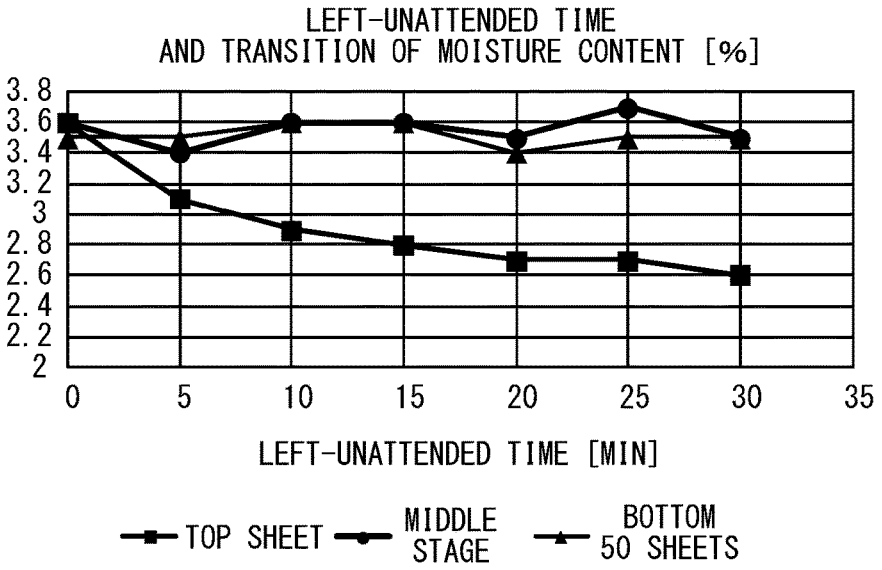
FIG. 12 is an explanatory graph of a temporal change in distribution of a content of moisture contained in sheets in a sheet feeding cassette.

FIG. 11A and FIG. 11B are explanatory graphs of a relationship between a transition of the length of the sheet 110 in the conveying direction and a front/back misregistration amount. FIG. 12 is an explanatory graph of a temporal change in the distribution of the content of moisture contained in the sheets 110 in the sheet feeding cassette 113.

From the first sheet to the about 100th sheet counted from the top surface in the sheet feeding cassette 113, the front/back misregistration amount shown in FIG. 11B increases in proportion to variations in the length of the sheet 110 in the conveying direction shown in FIG. 11A. The front/back misregistration during the print job transitions not only due to the variations in the length of the sheet 110 in the conveying direction but also due to the variations in the image shape in an image formation process. Therefore, the 200th sheet counted from the top surface in the sheet feeding cassette 113 and the subsequent sheets exhibit variations in the front/back misregistration as shown in FIG. 11B irrespective of the variations in the length of the sheet 110 in the conveying direction.

In addition, the first sheet to the about 100th sheet counted from the top surface in the sheet feeding cassette 113 exhibit a sharp change in the length of the sheet 110 in the conveying direction shown in FIG. 11A because the content of moisture contained in the sheet 110 is different depending on the position in the sheet feeding cassette 113. As shown in FIG. 12, the content of moisture contained in the sheet 110 in the sheet feeding cassette 113 sharply changes in the top surface part depending on the left-unattended time (in proportion to the length of the sheet 110 in the conveying direction), and does not change at the middle stage and the lower stage even after the left-unattended time has elapsed.

Figure 13:
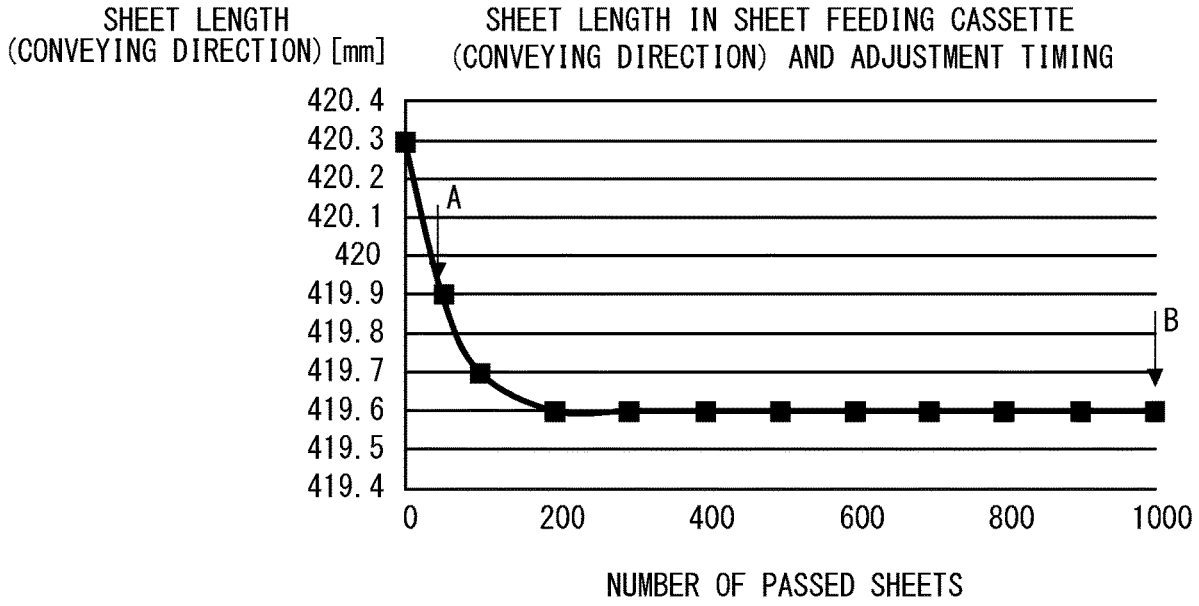
FIG. 13 is an explanatory graph of a transition of the length of a sheet in the conveying direction and a timing of the front/back registration processing.

The adjustment unit 400 in this embodiment is configured to automatically perform the front/back registration in-line. In such a configuration, every time images have been formed on the sheets 110 of a predetermined number, the adjustment sheet 801 for front/back registration illustrated in FIG. 7 is created to adjust the geometric characteristics. In this embodiment, in addition to such adjustment of the geometric characteristics performed for each predetermined number of sheets, the geometric characteristics are also adjusted at a timing different from the interval of the predetermined number of sheets. FIG. 13 is an explanatory graph of the transition of the length of the sheet 110 in the conveying direction and the timing of the geometric adjustment (front/back registration processing).

In this embodiment, in the first print job after the image forming apparatus 1 is powered on, the geometric adjustment is performed at a time point at which sheets of a first predetermined number (for example, 30 sheets (timing A)) different from the predetermined number of sheets have been passed, separately from the set timing. After that, the geometric adjustment is performed as processing that interrupts the print job at a time point at which sheets of a second predetermined number (for example, 1,000 sheets (timing B)) being the predetermined number of sheets set by the user have been passed. The first predetermined number of sheets is a fixed number determined in advance. It is desired that the first predetermined number of sheets be 100 or smaller. This is because variations in the dimensions of the sheet is large when the number of sheets 110 on which an image is formed (number of sheets having an image formed thereon) is 100 or smaller. Meanwhile, the second predetermined number of sheets is a periodic condition for periodically creating the adjustment sheet 801 illustrated in FIG. 7, and can be set to any number by the user. It is preferred that the first predetermined number of sheets be smaller than the second predetermined number of sheets. The geometric adjustment may be performed not only after the image forming apparatus 1 is powered on but also every job or depending on a time period between jobs. However, when the first predetermined number of sheets is larger than the second predetermined number of sheets, the adjustment sheet 801 is not created even when the first predetermined number of sheets is reached. This is because the adjustment sheet 801 is created when the number of sheets 110 on which the user image is formed during the print job reaches the second predetermined number of sheets before reaching the first predetermined number of sheets.

In this case, when the lower limit of a range that can be designated by the user as the second predetermined number of sheets is 40, the adjustment sheet 801 is not required to be output at a time point at which the sheets of the first predetermined number (40 sheets) have been passed. It suffices that the printer controller 103 is configured to determine whether or not the second predetermined number of sheets serving as a user-designated number of sheets is larger than a threshold number of sheets, and when the second predetermined number of sheets is larger than the threshold number of sheets, cause the adjustment sheet 801 to be output after the first predetermined number of sheets smaller than the threshold number of sheets is reached.

The printer controller 103 determines not only the number of sheets 110 on which an image has been formed but also whether or not to perform the geometric adjustment at a timing different from the interval of the predetermined number of sheets in the processing step of Step S1002 of FIG. 8. For example, when the image formation of a new print job is started, the printer controller 103 determines whether or not an elapsed time from the start of the formation of the user image based on the new print job has reached a predetermined time period. The adjustment sheet 801 may be read after the elapsed time reaches the predetermined time period. In another case, the printer controller 103 may determine whether or not the images have been formed on the sheets of the first predetermined number and whether or not the elapsed time from the start of the formation of the user image based on the new print job has reached the predetermined time period. In this configuration, the adjustment sheet 801 is created after the number of sheets on which the user image has been formed reaches the first predetermined number of sheets or the elapsed time reaches the predetermined time period.

Thus, the geometric characteristics are adjusted in the first half of a job before the set predetermined number of sheets is reached, and it is possible to suppress the front/back misregistration due to a rapid change in the length of the sheet 110 in the conveying direction in the first half of the job. It is also possible to prevent a decrease in actual productivity when the geometric adjustment (printing position adjustment) is performed in a process of interrupt processing and to prevent aggravation of the front/back misregistration in the early stage. At this time, a magnification correction value for the image may be offset in anticipation that the length of the sheet 110 in the conveying direction in the first half of the job exhibits a sharp change.

Figure 14:
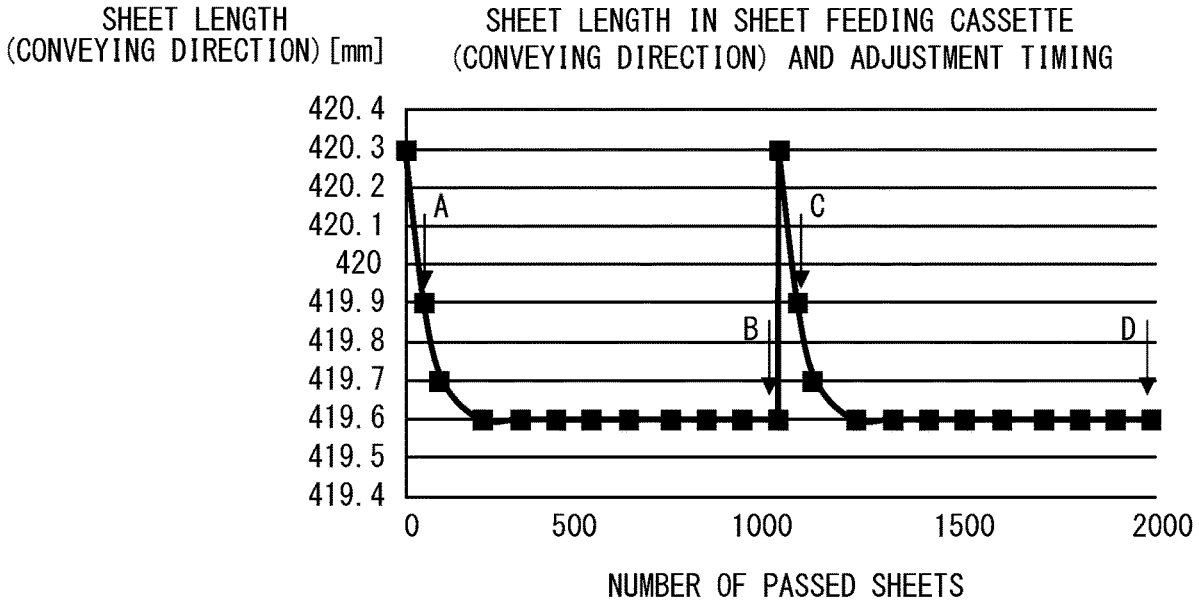
FIG. 14 is another explanatory graph of the transition of the length of a sheet in the conveying direction and the timing of the front/back registration processing.

In the configuration of this embodiment in which front/back registration is automatically performed in-line, after a print job is started, the adjustment sheet 801 for front/back registration is created for each fixed predetermined number of sheets to perform the geometric adjustment. FIG. 14 is another explanatory graph of the transition of the length of the sheet 110 in the conveying direction and the timing of the geometric adjustment (front/back registration processing).

In FIG. 14, after the start of the job, the geometric adjustment is performed at the time point at which the sheets of the first predetermined number (for example, 30 sheets (timing A)) have been passed, separately from the set timing. After that, when the sheets of the second predetermined number (for example, 1,000 sheets (timing B)) set by the user have been passed, the geometric adjustment is performed as the interrupt processing. The same processing as that of FIG. 13 is performed so far.

In addition thereto, in FIG. 14, every time the sheet to be used for printing or the sheet feeding cassette for the sheet feeding is changed after the sheets of the second predetermined number have been passed (the 1,000th sheet has been passed), the geometric adjustment is performed after sheets of a third predetermined number (for example, 30 sheets (timing C)) have been passed, separately from the set timing. After that, the geometric adjustment is performed at a time at which the sheets of the second predetermined number set by the user have been passed ((1,000+1,000)th sheet has been passed (timing D)).

Thus, the geometric adjustment is performed in the first half of a job before the set number of sheets is reached, and it is possible to suppress the front/back misregistration due to a rapid change in the length of the sheet 110 in the conveying direction in the first half of the job. In addition thereto, it is also possible to suppress the front/back misregistration due to the variations in length of the sheet 110 in the conveying direction, which have been caused after the sheets 110 are left unattended in another sheet feeding cassette.

The printer 100 and the adjustment unit 400 have been described above as different devices independent of each other, but may be integrally configured. For example, when the reading unit 500 is arranged in the discharge path 139 included in the printer 100 and configured such that the discharge destination of the sheet 110 is branched off on the downstream side of the reading unit 500, the printer 100 and the adjustment unit 400 are integrally configured. Further, the reading unit 500 of the adjustment unit 400 may be arranged in the discharge path 432 of the adjustment unit 400. In this case, the adjustment sheet 801 is guided to the discharge path 432 by the branch flapper 422, and then the test image is read.

As described above, according to the embodiment of the present disclosure, it is possible to acquire the adjustment value of the geometric characteristic at an appropriate timing, and it is possible to perform image formation that suppresses the front/back misregistration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-013708, filed Jan. 29, 2021, which is hereby incorporated by reference herein in its entirety.

What is claimed is:

1. An image forming apparatus comprising:

an image forming unit configured to form an image on a sheet;

a conveyance unit configured to convey the sheet having the image formed thereon along a conveyance path;

a reading unit configured to read the image on the sheet conveyed to the conveyance path; and a controller configured to:

receive a user-designated number of sheets as a condition for a timing at which the image forming unit forms a mark during a period in which a print job for forming a plurality of images on a plurality of sheets is being executed;

control, when the print job is executed, the image forming unit to form the mark after the images are formed on sheets of a predetermined number smaller than a threshold number of sheets in a case in which the user-designated number of sheets is larger than the threshold number of sheets;

control, when the print job is executed, the image forming unit to form the mark every time images are formed on the sheets of the user-designated number of sheets;

control the conveyance unit to convey the sheet having the mark formed thereon;

control the reading unit to read the mark on the sheet; and control geometric characteristics of an image to be formed on the sheet based on a result of reading the mark by the reading unit.

2. The image forming apparatus according to claim 1, wherein the controller is configured to control the image forming unit to form the mark before the images have been formed on the sheets of the predetermined number when an elapsed time from a start of image formation which is based on the print job reaches a predetermined time period before the images have been formed on the sheets of the predetermined number.

3. The image forming apparatus according to claim 1, wherein the controller is configured to control the geometric characteristics of an image to be formed on each sheet before the images have been formed on the sheets of the user-designated number, based on a result of reading, by the reading unit, the mark formed after the images had been formed on the sheets of the predetermined number.

4. The image forming apparatus according to claim 1, wherein the image forming unit includes: a sheet stacker in which a plurality of sheets are to be stacked; and a feeding roller configured to feed a sheet from the sheet stacker, and wherein the image forming unit is configured to form the image on the sheet fed by the feeding roller.

5. An image forming apparatus comprising:

an image forming unit configured to form an image on a sheet;

a conveyance unit configured to convey the sheet having the image formed thereon to a conveyance path;

a reading unit configured to read the image on the sheet conveyed to the conveyance path; and a controller configured to:

receive a user-designated number of sheets as a condition for a timing at which the image forming unit forms a mark during a period in which a print job for forming a plurality of images on a plurality of sheets is being executed;

control, when the print job is executed, the image forming unit to form the mark before images are formed on sheets of the user-designated number in a case in which an elapsed time from a start of image formation based on the print job has reached a predetermined time period;

control, when the print job is executed, the image forming unit to form the mark every time the images are formed on the sheets of the user-designated number;

control the conveyance unit to convey the sheet having the mark formed thereon;

control the reading unit to read the mark on the sheet; and control geometric characteristics of an image to be formed on the sheet based on a result of reading the mark by the reading unit.

6. The image forming apparatus according to claim 5, wherein the controller is configured to control the geometric characteristics of an image to be formed on each sheet before the images have been formed on the sheets of the user-designated number, based on a result of reading, by the reading unit, the mark formed after the elapsed time had reached the predetermined time period.

7. The image forming apparatus according to claim 5, wherein the image forming unit includes: a sheet stacker in which a plurality of sheets are to be stacked; and a feeding roller configured to feed a sheet from the sheet stacker, and wherein the image forming unit is configured to form the image on the sheet fed by the feeding roller.

* * * * *